US007557507B2

(12) United States Patent
Wu et al.

(10) Patent No.: US 7,557,507 B2
(45) Date of Patent: Jul. 7, 2009

(54) ELECTRODE AND METHOD OF MANUFACTURE

(75) Inventors: Yi-Jen Wu, Longtan Township, Taoyuan County (TW); Wen-Fa Sung, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 0 days.

(21) Appl. No.: 10/751,607

(22) Filed: Jan. 5, 2004

(65) Prior Publication Data

US 2005/0146273 A1 Jul. 7, 2005

(51) Int. Cl.
*H01J 17/49* (2006.01)

(52) U.S. Cl. ..... 313/584; 313/582

(58) Field of Classification Search ..... 313/491, 313/582–587, 631; 445/23–25; 315/169.1, 315/169.3

See application file for complete search history.

(56) References Cited

U.S. PATENT DOCUMENTS

| | | | | |
|---|---|---|---|---|
| 3,742,279 | A * | 6/1973 | Kupsky et al. | 313/484 |
| 4,164,678 | A * | 8/1979 | Biazzo et al. | 313/582 |
| 6,445,120 | B1 | 9/2002 | Kim et al. | |
| 6,469,441 | B1 | 10/2002 | Choi | |
| 7,164,394 | B2 * | 1/2007 | Hirose et al. | 345/60 |
| 2005/0174057 | A1 * | 8/2005 | Su | 313/583 |
| 2006/0132039 | A1 * | 6/2006 | Murai et al. | 313/583 |

FOREIGN PATENT DOCUMENTS

| | | |
|---|---|---|
| CN | 1407583 A | 4/2003 |
| JP | 05-013005 | 1/1993 |
| JP | 06-044907 | 2/1994 |
| JP | 2003-068209 | 3/2003 |
| TW | 0394915 | 6/2000 |
| TW | 0521291 | 2/2003 |

OTHER PUBLICATIONS

Office Action, Non-Final Rejection in Corresponding Japanese parent application (P2005-000006) issued Sep. 3, 2007; including Examiner's statement of relevance of cited references.

* cited by examiner

*Primary Examiner*—Joseph L Williams
(74) *Attorney, Agent, or Firm*—Duane Morris LLP

(57) ABSTRACT

An electrode on a substrate of a plasma display panel has a relatively narrow bus line conductor at an intersection with a pad, and a line width of the pad being wider than a line width of the bus line conductor and substantially narrower than a line width of a wider section of the pad, which avoids a break in the electrode when the electrode is fired at an elevated temperature.

6 Claims, 12 Drawing Sheets

ELECTRODE AND METHOD OF MANUFACTURE

FIELD OF THE INVENTION

The present invention relates to an electrode for a plasma display panel, PDP, and to a method of manufacturing the electrode on a substrate of a PDP.

BACKGROUND

A plasma display panel has a substrate on which electrodes are fabricated by performing industry known, photolithographic process steps. First, a photo resist covers a layer of electrode material on the substrate. The, according to a development process, photolithographic patterning is performed by directing a beam of electromagnetic radiation through a patterned photolithographic mask. The beam is patterned by the mask, and is focused to irradiate a photo resist layer with an un-irradiated pattern. Then, the patterned photo resist layer is washed with a developer to remove the non-irradiated part, which leaves behind a patterned photo resist. The patterned photo resist covers a layer of electrode material on the substrate.

With the patterned photo resist in place, selective etching is performed to etch the electrode material, which forms a pattern of electrodes on the substrate of the plasma display panel. The electrodes have elongated bus line conductors that interconnect with spaced apart contact pads.

Then the substrate and the pattern of electrodes are fired, at elevated temperatures to drive off organic compounds, to unify electrode particles into a solid mass, and to increase the conductivity, durability and permanence of the electrodes under voltage stress, as well as, to secure the electrodes on the substrate.

FIG. 4 discloses an exemplary pattern of electrodes having bus line conductors connected to pads. The bus line conductors have narrow widths, or narrow width dimensions. The pads have wide widths, or wide width dimensions, because the pads need relatively large surface areas to establish electrical connections with corresponding, hexagonal shaped pixel electrodes. As disclosed by FIG. 4, the pixel electrodes cover and engage corresponding pads.

FIG. 5 discloses a break in the electrode pattern. The break appears during the process of developing the electrode pattern, or during the process of firing the electrode pattern.

The break is caused by development of a patterned electrode with an abrupt change in the width of an electrode where a corresponding, narrow bus line conductor intersects a wide pad. When the patterned mask is developed, a fluent developer flows lengthwise of the electrodes. Because the electrodes lack a streamlined profile, the fluent developer erodes side cuts laterally into the patterned mask. The side cuts in the patterned mask are transferred to the electrodes, which make electrodes that are weakened by patterned side cuts, and susceptible to a break. During a firing process at a temperature elevated above ambient, a break in an electrode is due to a wide width of the pad that shrinks more, while cooling, than does the narrow width of an intersecting bus line conductor.

SUMMARY OF THE INVENTION

A motivation for the invention is to avoid a break that would occur in an electrode of a plasma display device.

According to an embodiment of the invention, the electrode profile is made to be streamlined or curved, such that developer flow avoids erosion of a side cut at a sharp angle in the profile of a patterned mask that would cause an electrode break.

According to another embodiment of the invention, the line width of the electrode changes gradually from narrow to wide, which avoids causing an electrode break during the firing process.

According to an embodiment of the invention, at the intersection of a bus line conductor and a pad, the line width of the electrode is wider than a line width of the bus line conductor and narrower than a line width of a wider section of the pad.

Embodiments of the invention will now be described by way of example with reference to the accompanying drawings.

DETAILED DESCRIPTION

Figure 1:
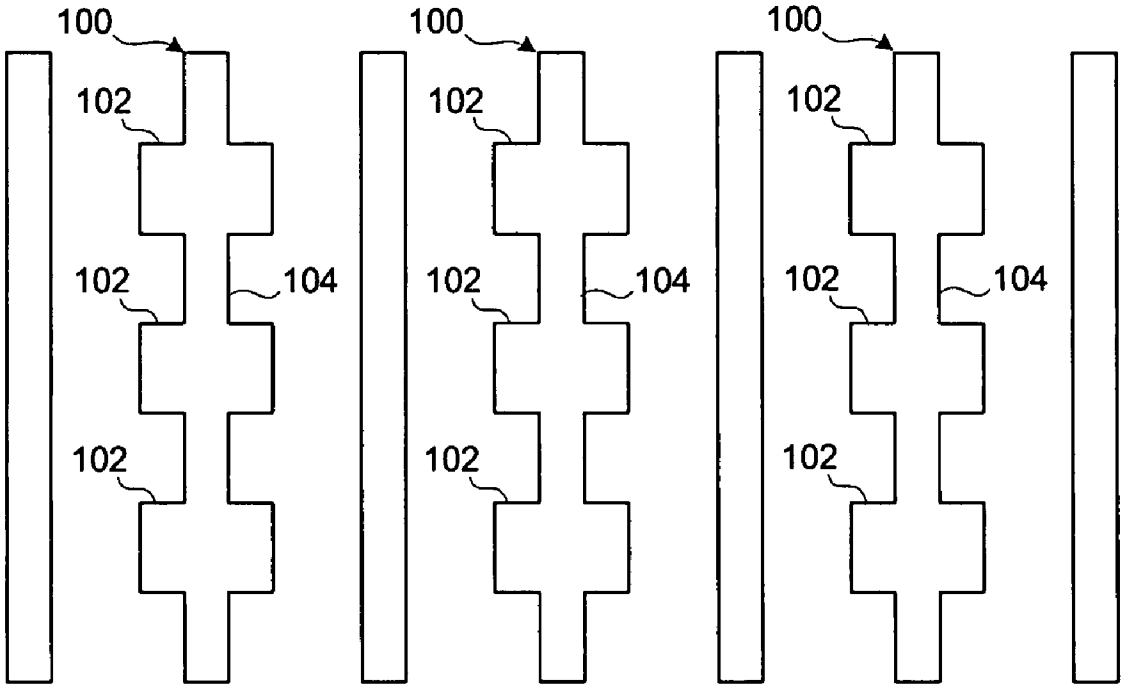
FIG. 1 (Prior Art)
FIG. 1 is an enlarged plan view of prior art patterned electrodes on a substrate of a plasma display panel.
Figure 2:
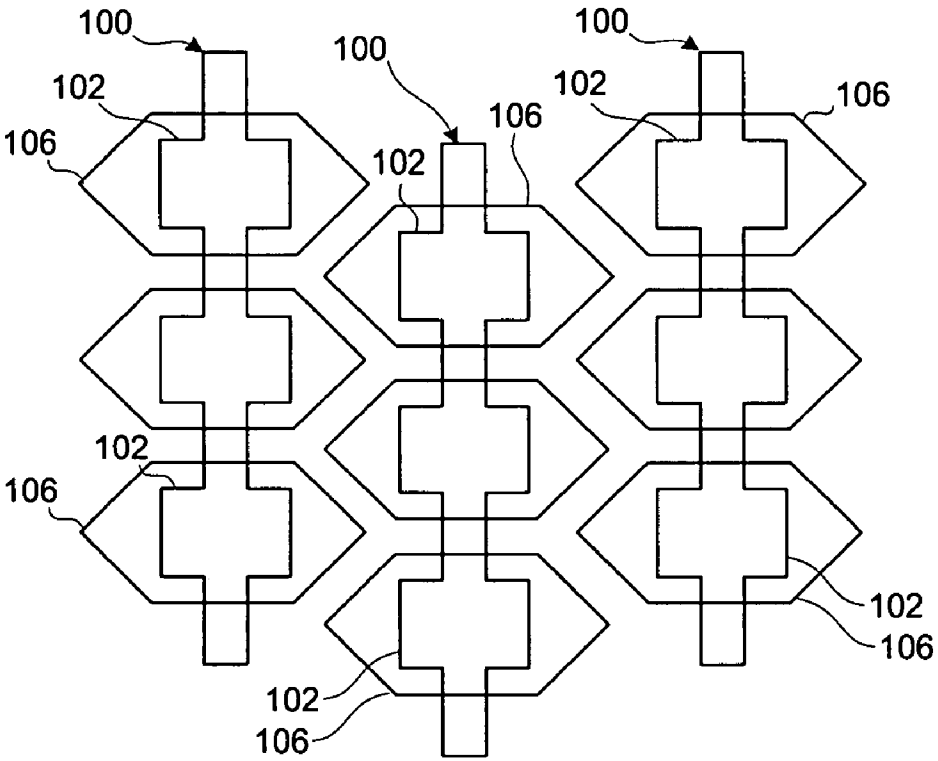
FIG. 2 (Prior Art)
FIG. 2 is a view similar to FIG. 1, and further disclosing hexagonal pixel electrodes.
Figure 3:
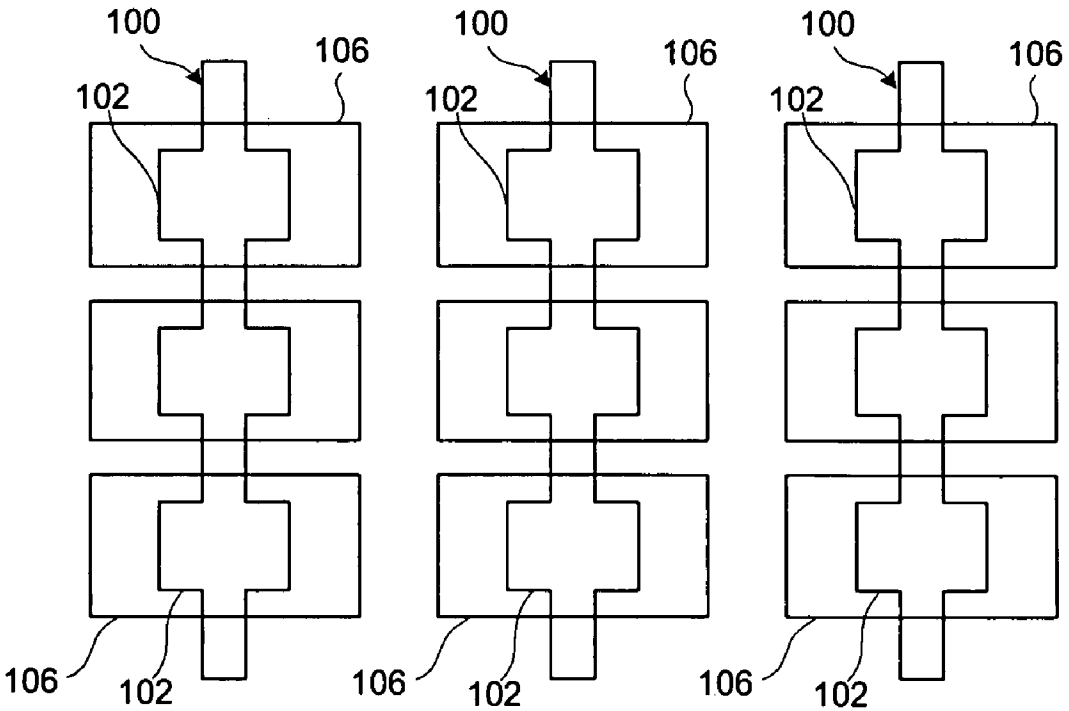
FIG. 3 (Prior Art)
FIG. 3 is a view similar to FIG. 1, and further disclosing rectangular pixel electrodes.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 discloses multiple, patterned electrodes (100) for a plasma display device. Each electrode (100) has one or more enlarged pads (102). Each pad (102) of a corresponding electrode (100) joins a corresponding bus line conductor (104) of the electrode (100). Each of FIGS. 2-5 discloses patterned electrodes (100) that are similar to those disclosed by FIG. 1.

Figure 4:
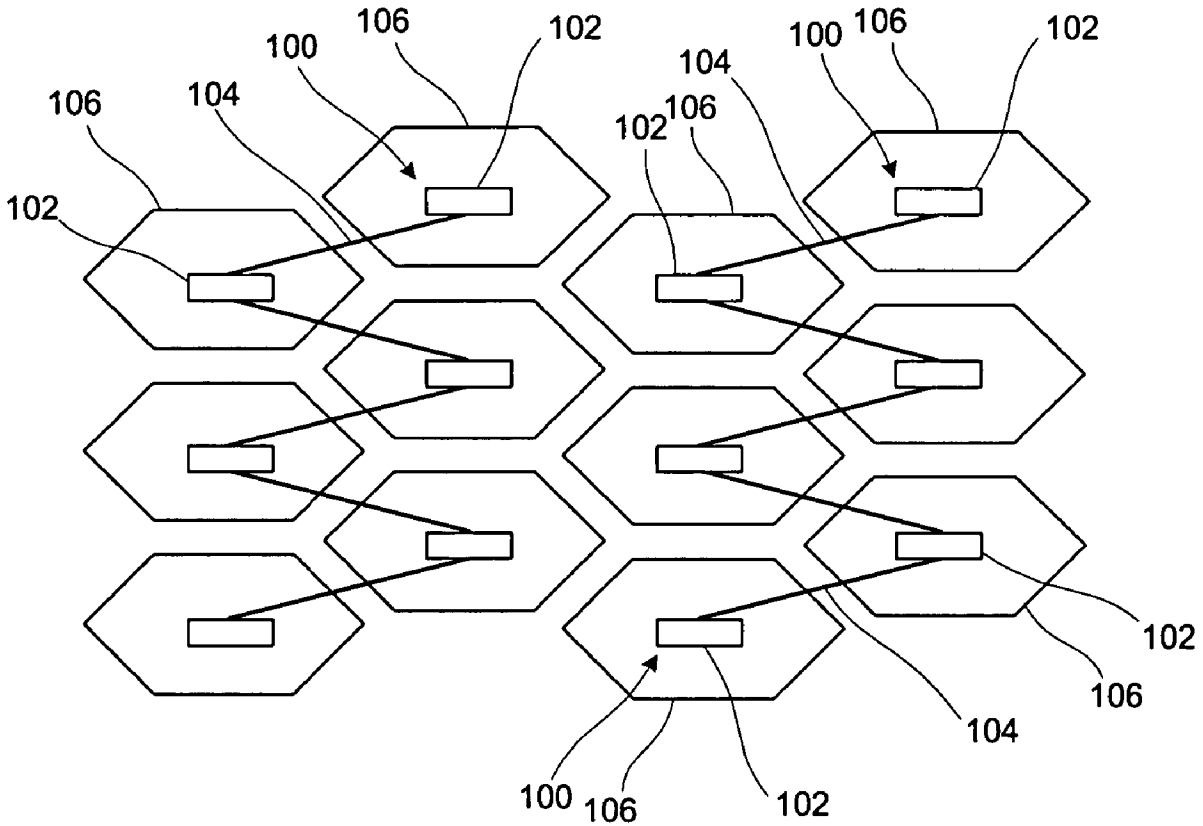
FIG. 4 (Prior Art)
FIG. 4 is a view similar to FIG. 1, and further disclosing hexagonal pixel electrodes joining corresponding bus line conductors.

FIG. 4 discloses an exemplary pattern of prior art electrodes (100) having bus line conductors (104) connected to pads (102). The bus line conductors (104) have narrow line widths, or narrow width dimensions. The pads (102) have wide line widths, or wide width dimensions, because the pads (102) need relatively large surface areas to establish electrical connections with corresponding, hexagonal shaped pixel electrodes (106). As disclosed by FIG. 4, the pixel electrodes (106) cover and engage corresponding pads (102).

Figure 5:
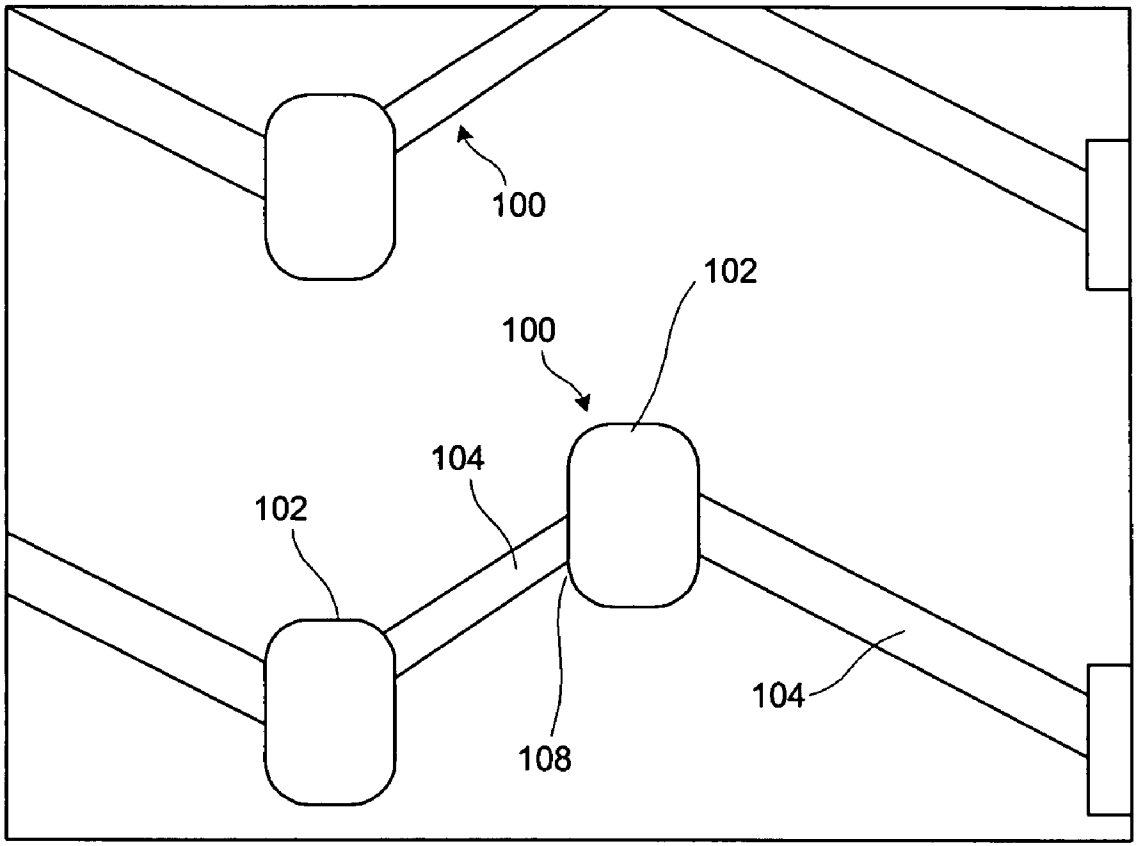
FIG. 5 (Prior Art)
FIG. 5 is a view of a break in a patterned electrode.

FIG. 5 discloses a break (108) in the electrode pattern. The break (108) appears during the process of developing the electrode pattern, or during the process of firing the electrode pattern. The break (108) includes, and is not limited to, cracking and severing of the electrode pattern. The break (108) most often occurs at an intersection of a narrow width bus line conductor (104) and a wide width pad (102).

The break (108) is caused, for example, by development of a patterned electrode (100) with an abrupt change in the width of an electrode (100) at an intersection (110) of a corresponding, narrow bus line conductor (104) and a wide pad (102). In the embodiments disclosed by FIGS. 1-5, the narrow bus line conductor (104) intersects directly with the widest section (112) of a pad (102). A break (108) is caused, for example, during the development process, when a fluent developer washes over the electrode (100), and erodes side cuts in the electrode pattern. Further, a break (108) is caused, for example, during firing, because the wide width of the pad (102) shrinks more, while cooling, than the narrow width of an intersecting bus line conductor (104).

Each of FIGS. 6-12 discloses an embodiment of an electrode (100) on a substrate of a plasma display device. Each electrode (100) has a length that extends along a line from one end (100*a*) of the electrode (100) to an opposite end (100*b*) of the electrode (100). Each electrode (100) has a line width, measured transverse to the length of the electrode (100). Each electrode (100) has a bus line conductor (104) of narrow line width at each intersection (110) with an enlarged pad (102) of wider line width. According to the invention, an intersection (110) is defined at a location where the line width of an electrode (100) begins to increase, and, thereby, becomes a line width of a pad (102) that joins the bus line conductor (104) of narrower line width.

The invention avoids an intersection (110) of a bus line conductor (104) with a pad (102) at its widest line width on a widest section (112) of a pad (102). Instead, the intersection (110) has a line width that is smaller than the line width of a pad (102) at its widest section (112).

At an intersection (110) of each pad (102) with a corresponding bus line conductor (104), a line width of the pad (102) is wider than a line width of the bus line conductor (104), and is substantially narrower than a line width of a wider section (114) of the pad (102). The line width of the pad (102) at the intersection (110) is substantially narrower, which means that the line width is purposely dimensioned to be narrower, than the line width of a wider section (114) of the pad (102). A pad (102) with that feature avoids being a cause for a break (108) in the electrode (100). According to the embodiments of the invention, the wider section (114) of the pad (102) is between the intersection (110) and the widest section (112) of the pad.

Figure 6:
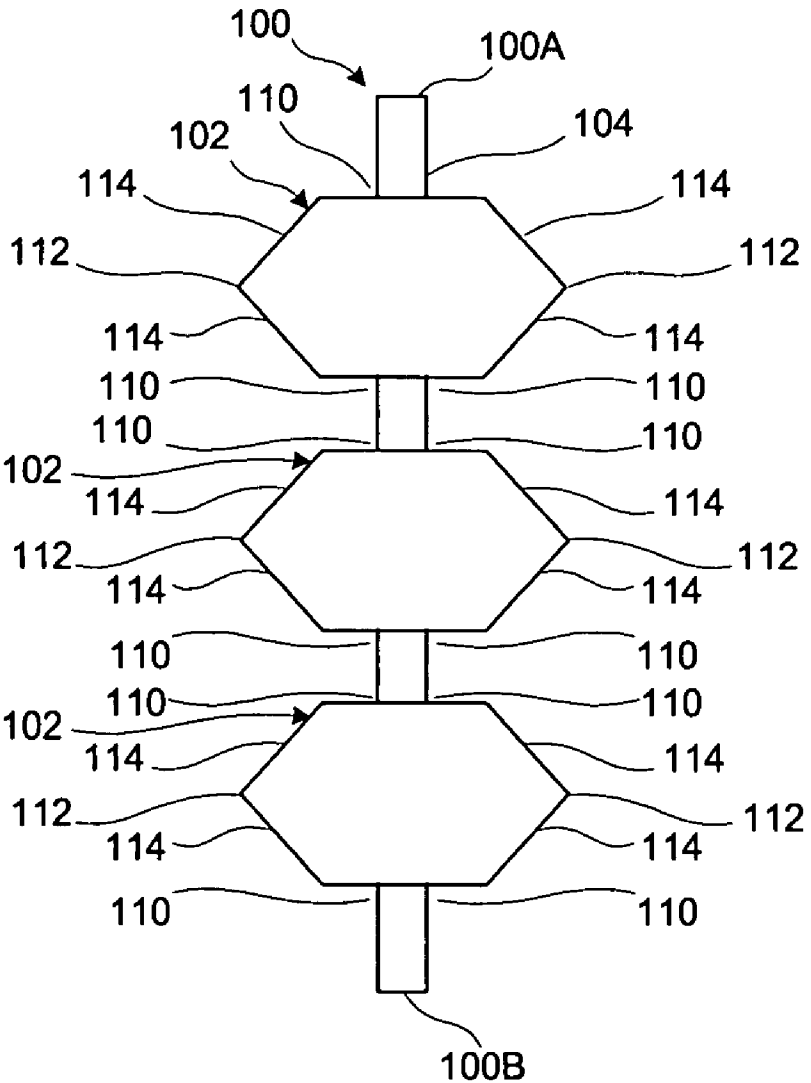
FIG. 6 is an enlarged plan view of a patterned electrode according to an embodiment of the invention.
Figure 7:
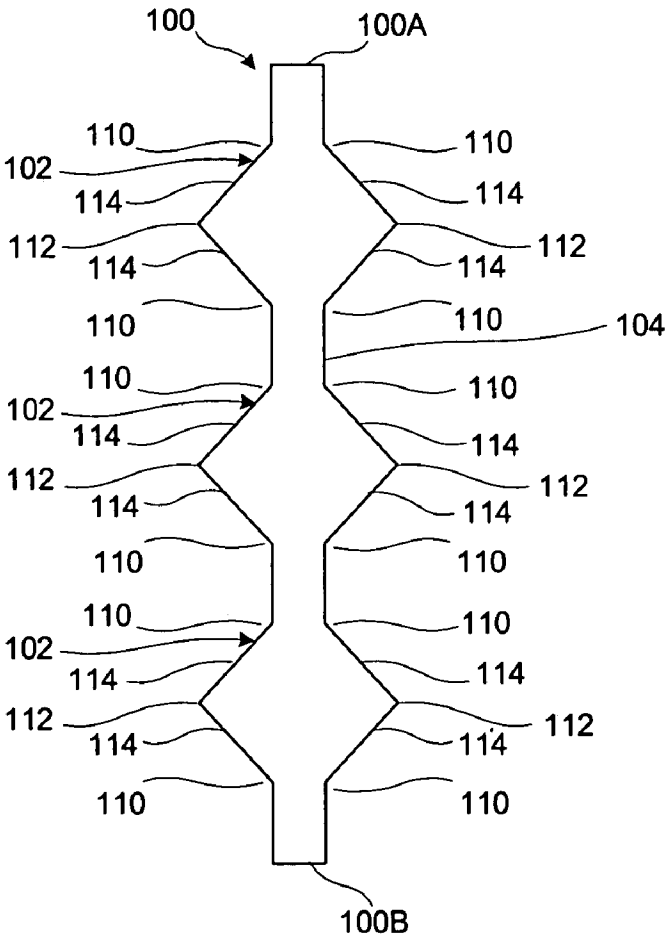
FIG. 7 is an enlarged plan view of a patterned electrode according to another embodiment of the invention.
Figure 9:
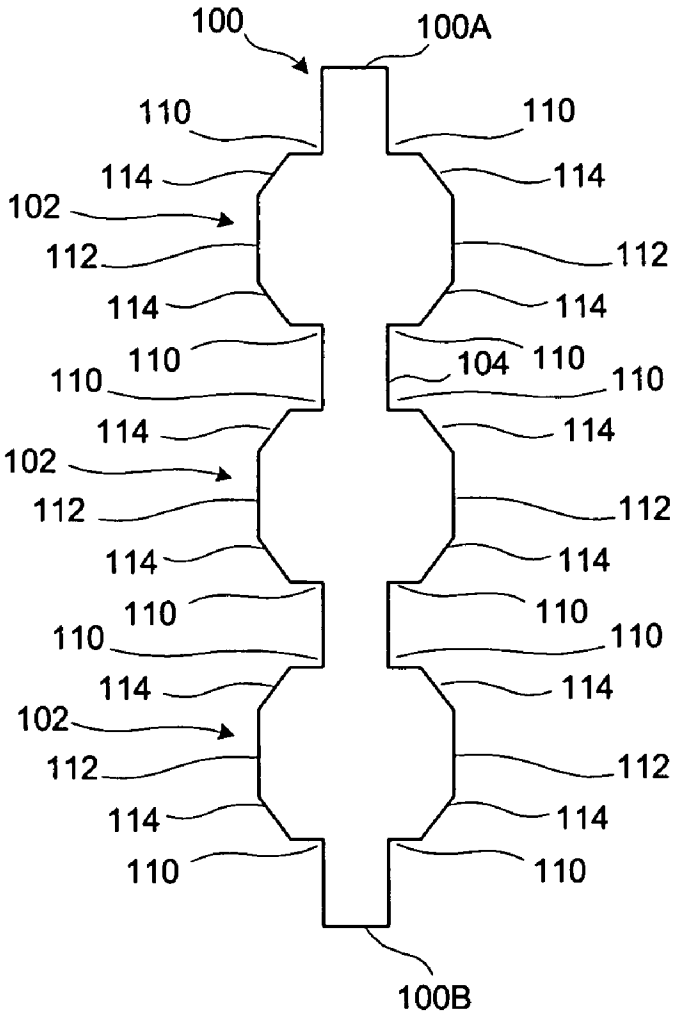
FIG. 9 is an enlarged plan view of a patterned electrode according to another embodiment of the invention.
Figure 11:
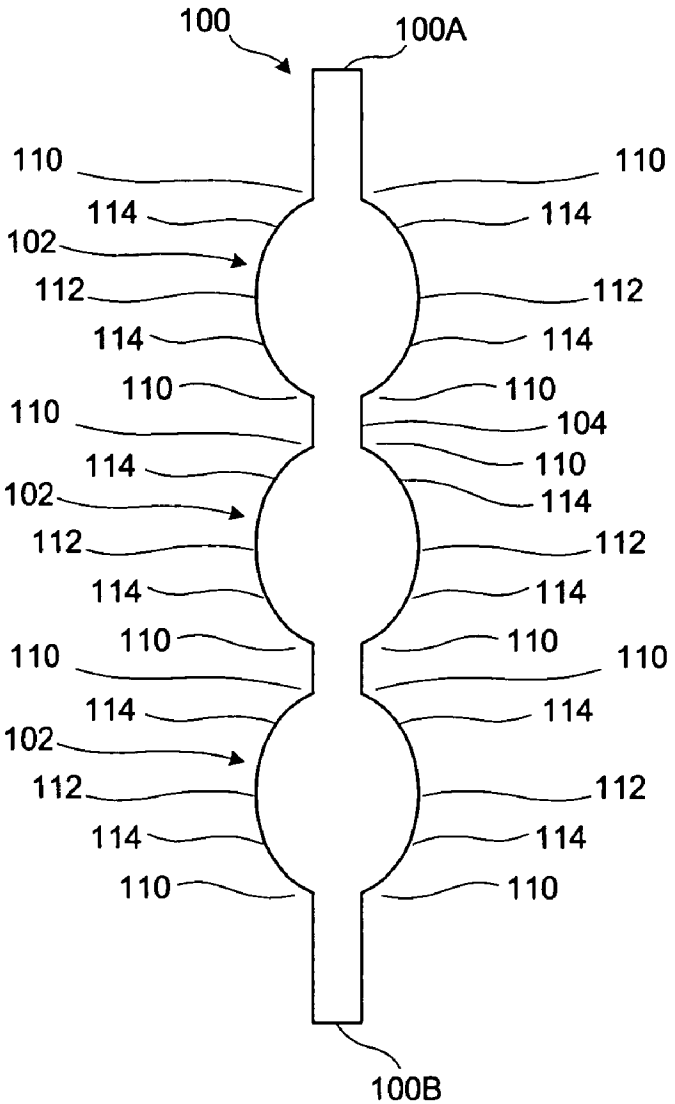
FIG. 11 is an enlarged plan view of a patterned electrode according to another embodiment of the invention.

Each of FIGS. 6, 9 and 11 discloses an embodiment of the present invention wherein, an abruptly increased line width is on a portion of the electrode (100) between the intersection (110) and the wider section (114), which avoids being a cause for a break (108) in the electrode (100). According to the prior art electrodes (100), the abruptly increased line width extends directly from a narrow section to the widest section (112) of a pad (102), which would not avoid being a cause for a break (108) in the electrode (100).

According to an embodiment of the invention, the line width of the electrode (100) changes gradually from narrow to wider, which avoids causing an electrode break (108) during a firing process. Each of FIGS. 6-12 discloses an embodiment of the invention wherein, the wider section (114) of the pad (102) has a feature of a gradually increasing width, so as to further avoid being a cause for a break (108) in the electrode (100).

According to an embodiment of the invention, the electrode profile is made by the development process to be streamlined or curved, to eliminate erosion caused by the fluent developer to erode a side cut at a sharp angle in the profile, which would cause an electrode break (108). The streamlined or curved profile extends along a line width of the electrode (100) that changes gradually from narrow to wider. Further, according to an embodiment disclosed by each of FIGS. 11 and 12, the maximum width section is on a curved profile of the pad (102).

Each of FIGS. 6-12 discloses an embodiment of the invention wherein, the pad (102) has a maximum width section. According to FIGS. 6 and 7, the maximum width section is on a pointed profile of the pad (102). A profile refers to a peripheral edge and its features of shape or appearance.

Figure 8:
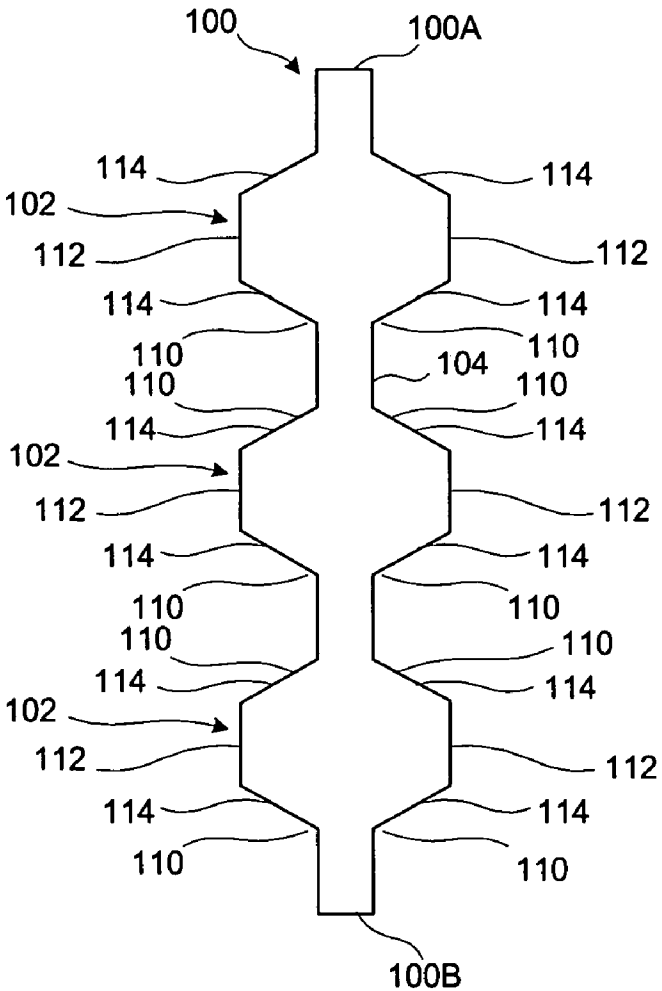
FIG. 8 is an enlarged plan view of a patterned electrode according to another embodiment of the invention.
Figure 10:
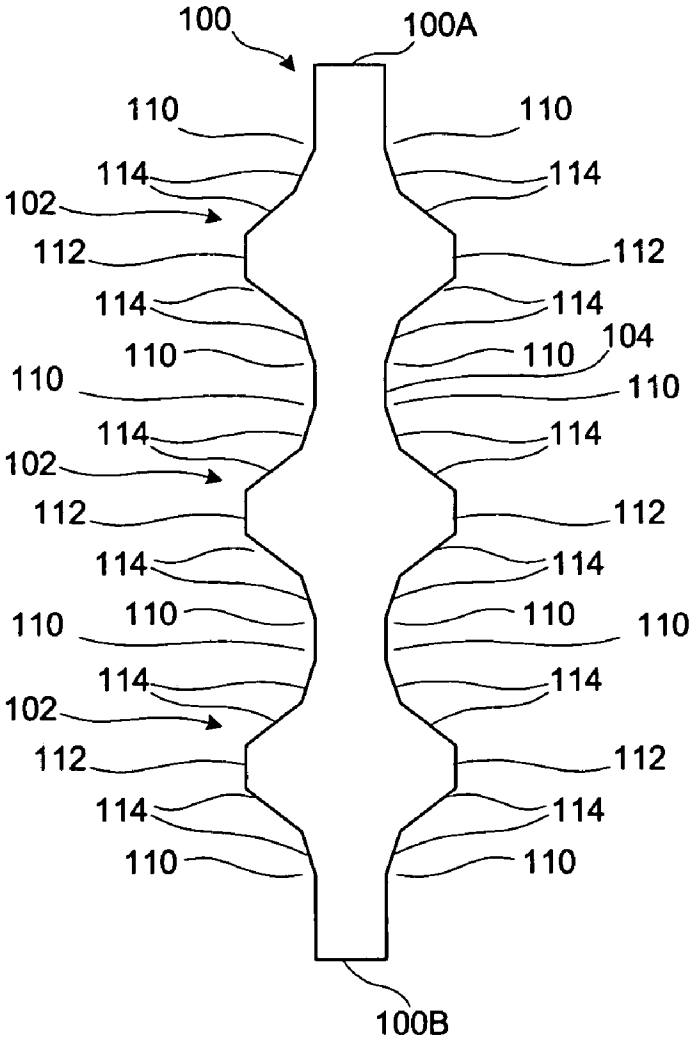
FIG. 10 is an enlarged plan view of a patterned electrode according to another embodiment of the invention.

Further, according to an embodiment disclosed by each of FIGS. 8, 9 and 10, the section of maximum width is on a straight profile of the pad (102).

Further, according to an embodiment disclosed by each of FIGS. 9, 10 and 11, a portion of the electrode (100) between the intersection (110) and the wider section (114) of the pad (102) has a first tapered profile. The wider section (114) of the pad (102) has a second tapered profile.

According to an embodiment disclosed by each of FIGS. 7, 8, 9, 10, 11 and 12, a portion of the electrode (100) between the intersection (110) and the section of maximum width has a tapered profile. The profile is a straight tapered profile according to an embodiment disclosed by each of FIGS. 7, 8 and 10. According to the embodiment disclosed by FIG. 12, the profile is concave and tapered.

Figure 12:
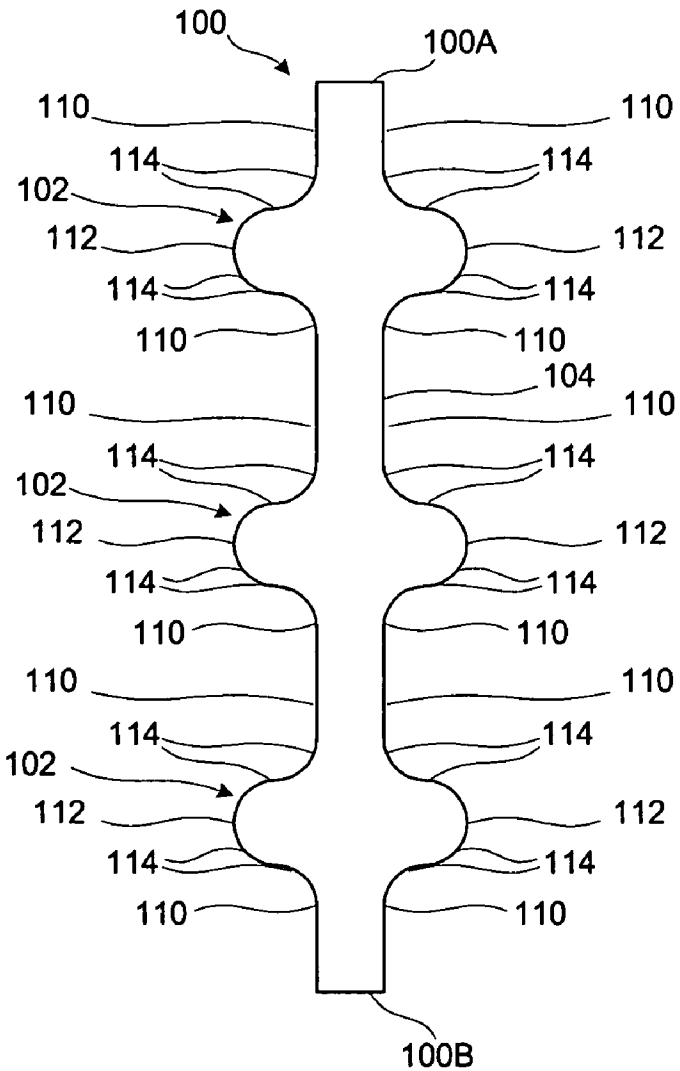
FIG. 12 is an enlarged plan view of a patterned electrode according to another embodiment of the invention.

Each of FIGS. 11 and 12 discloses an embodiment of the present invention wherein, the profile is streamlined or curved.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. An electrode for a plasma display panel, comprising:

at least one bus line conductor; and at least one pad connected with the at least one bus line conductor, the at least one pad including opposing side sections, each of the side sections having a blunted triangular shape, the side sections tapering away from an interior portion of the at least one pad, wherein the interior portion of the at least one pad includes blunted triangular shape end portions, one of the end portions connecting with the at least one bus line conductor.

2. An electrode for a plasma display panel, comprising:

at least one bus line conductor; and at least one pad connected with the at least one bus line conductor, the at least one pad including opposing side sections, each of the side sections having a blunted triangular shape, the side sections tapering away from an interior portion of the at least one pad, wherein the at least one pad has an octagonal shape.

3. The electrode of claim 2, wherein the interior portion of the at least one pad is rectangular in shape.

4. The electrode of claim 1, wherein the side sections of the at least one pad each have a portion that gradually increases in width.

5. The electrode of claim 1, wherein the side sections of the at least one pad gradually increase in width.

6. The electrode of claim 1, wherein the at least one bus line conductor has a first width and the side sections have a maximum width that is greater than the first width, each of the side sections having a portion that is narrower than the maximum width and that intersects the at least one bus line conductor.

* * * * *